US012522395B2

(12) United States Patent
Castagna et al.

(10) Patent No.: US 12,522,395 B2
(45) Date of Patent: Jan. 13, 2026

(54) METHOD OF APPLYING A HANDLE TO A NETTING ROLL FOR ROUND BALERS

(71) Applicant: Novatex Italia S.p.A., Oggiono LC (IT)

(72) Inventors: Natale Castagna, Oggiono LC (IT); Marco Casati, Oggiono LC (IT)

(73) Assignee: Novatex Italia S.p.A., Oggiono LC (IT)

( * ) Notice: Subject to any disclaimer, the term of this patent is extended or adjusted under 35 U.S.C. 154(b) by 49 days.

(21) Appl. No.: 18/689,900

(22) PCT Filed: Sep. 13, 2022

(86) PCT No.: PCT/IB2022/058621
§ 371 (c)(1),
(2) Date: Mar. 7, 2024

(87) PCT Pub. No.: WO2023/042074
PCT Pub. Date: Mar. 23, 2023

(65) Prior Publication Data

US 2024/0367833 A1 Nov. 7, 2024

(30) Foreign Application Priority Data

Sep. 14, 2021 (IT) ..... 102021000023627

(51) Int. Cl.
*B65B 61/14* (2006.01)
*B65B 13/02* (2006.01)
(Continued)

(52) U.S. Cl.
CPC ..... *B65B 61/14* (2013.01); *B65B 27/10* (2013.01); *B65B 35/24* (2013.01); *B65B 61/202* (2013.01); *B65D 85/66* (2013.01); *B65B 13/022* (2013.01)

(58) Field of Classification Search
CPC ..... B65B 61/14; B65B 35/24; B65B 13/022; B65B 27/10; B65B 61/202; B65D 85/66
See application file for complete search history.

(56) References Cited

U.S. PATENT DOCUMENTS 2,353,821 A * 7/1944 Fourness ..... D01G 99/00 53/118
2,864,212 A * 12/1958 Bruce ..... B65B 61/207 53/157
(Continued)

FOREIGN PATENT DOCUMENTS

DE 102005055518 A1 * 5/2007 ..... B65B 27/10
EP 0287177 A1 * 10/1988 ..... B65D 85/66
(Continued)

OTHER PUBLICATIONS

International search report and written opinion dated Feb. 24, 2023; Application No. PCT/IB2022/058621.

*Primary Examiner* — Anna K Kinsaul
*Assistant Examiner* — Mobeen Ahmed
(74) *Attorney, Agent, or Firm* — RANKIN, HILL & CLARK LLP; Erik J. Overberger

(57) ABSTRACT

Method of applying a handle (1) to a netting roll (2) for round balers using an application equipment (3), said method comprising the following steps: picking up, by means of a first operating element (5) of the application equipment (3), a ring body (11) of the handle (1); placing the roll (2) on the running plane of a belt conveyor (4) of the application equipment (3) and causing, by means of the belt conveyor (4), to run said roll (2) up to a second operating element (6) of the application equipment (3); conveying, by means of the first operating element (5), the ring body (11) of the handle (1) to position said ring body (11) at the second operating element (6); picking up, by means of the second operating element (6), the ring body (11) from the first operating element (5); fitting, by means of the second operating element (6), said ring body (11) onto the roll (2); exerting, by means of a third operating element (7) of the application equipment (3), a pulling force on said ring body (11); applying, by means of at least one applicator of the (Continued)

application equipment (3), at least one fixing element to the ring body (11) of the handle (1) and the roll (2) to fix said ring body (11) to the roll (2) and thus define a grip portion (13) of the handle (1); releasing, by means of the third operating element (7), the pulling force applied to the ring body (11).

9 Claims, 5 Drawing Sheets

(51) Int. Cl.

| | |
|---|---|
| ***B65B 27/10*** | (2006.01) |
| ***B65B 35/24*** | (2006.01) |
| ***B65B 61/20*** | (2006.01) |
| ***B65D 85/66*** | (2006.01) |

(56) References Cited

U.S. PATENT DOCUMENTS 3,186,333 A * 6/1965 Hoffman ..... B65B 13/022 100/9
3,557,516 A * 1/1971 Brandt ..... B65B 61/14 53/134.1
3,670,877 A * 6/1972 Reed ..... B65B 27/06 53/409
3,856,141 A * 12/1974 Reed ..... B65D 85/67 53/409
3,964,235 A * 6/1976 Miller ..... B65H 18/22 226/110
4,188,249 A * 2/1980 Fujio ..... B67B 5/034 53/291
4,247,005 A * 1/1981 Buxton ..... B65B 61/14 383/7
4,286,421 A * 9/1981 Fujio ..... B65C 3/065 53/399
4,502,905 A * 3/1985 Jung ..... B65B 13/327 140/57
4,537,006 A * 8/1985 Pieri ..... B65C 7/00 53/134.1
4,811,548 A * 3/1989 Reist ..... B65B 27/08 53/118
4,984,411 A 1/1991 Reist
5,165,216 A * 11/1992 May ..... B65B 61/14 53/134.1
5,385,087 A * 1/1995 Yao ..... B65B 27/10 100/9
5,791,121 A * 8/1998 Bernier ..... B65B 17/025 53/390
5,927,586 A * 7/1999 Matlock ..... B65D 63/18 227/39
6,902,367 B2 * 6/2005 Hataya ..... B65B 13/18 412/9
7,516,694 B1 * 4/2009 Eifler ..... B65B 27/10 53/556
8,096,097 B2 * 1/2012 Haschke ..... B65B 9/15 53/134.1
8,287,020 B1 * 10/2012 Guerin ..... A45C 11/00 294/148
9,027,868 B2 * 5/2015 Guerin ..... E04D 15/06 242/422.6
10,370,131 B2 * 8/2019 Quinones ..... B65B 63/04
11,623,775 B1 * 4/2023 Vaughn ..... B65B 13/06 100/26
12,358,668 B2 * 7/2025 Haidacher ..... B65B 13/20
2002/0007616 A1 * 1/2002 Lamamy ..... B65B 53/02 53/399
2003/0042159 A1 * 3/2003 Zubry ..... B65B 9/026 206/323
2003/0131564 A1 * 7/2003 Ailey, Jr. ..... B65B 61/14 53/413
2004/0154902 A1 * 8/2004 Schoeneck ..... B65G 47/841 198/419.3
2004/0168405 A1 * 9/2004 Kirk ..... B65B 9/15 53/134.1
2005/0129497 A1 * 6/2005 Bogatyrev ..... B65H 3/0816 414/788
2007/0056248 A1 * 3/2007 Duschek ..... G08B 13/2445 53/399
2008/0086987 A1 * 4/2008 Lucas ..... A01K 61/59 53/585
2010/0107563 A1 * 5/2010 Swift ..... B65B 13/022 53/399
2012/0210674 A1 * 8/2012 Perl ..... B65B 27/04 53/589
2014/0208694 A1 * 7/2014 Falise ..... B30B 9/3003 53/529
2014/0208700 A1 * 7/2014 Gamble ..... B65B 25/24 53/557
2016/0152366 A1 * 6/2016 Shaver ..... B29C 65/7847 53/134.1
2017/0001748 A1 * 1/2017 Zahn ..... B65B 41/04
2017/0057734 A1 * 3/2017 Slaats ..... B65D 63/18
2019/0071199 A1 * 3/2019 Cassoli ..... B65B 59/003
2019/0217979 A1 * 7/2019 Ribi ..... B65D 71/50
2020/0216206 A1 * 7/2020 Ribi ..... B65B 35/44
2022/0274728 A1 * 9/2022 Schloesser ..... B65D 71/08
2022/0289417 A1 * 9/2022 Rütten ..... B65B 59/001

FOREIGN PATENT DOCUMENTS

EP 1798164 A1 * 6/2007 ..... B65B 63/024
EP 2592020 A1 * 5/2013 ..... B65D 85/66
WO WO-0110737 A1 * 2/2001 ..... B65D 63/18
WO WO-2010037217 A1 * 4/2010 ..... B65B 13/022
WO WO-2011042199 A1 * 4/2011 ..... G09F 3/206

* cited by examiner

METHOD OF APPLYING A HANDLE TO A NETTING ROLL FOR ROUND BALERS

TECHNICAL FIELD

The present invention relates to a method of applying a handle to a netting roll for round balers. Such a method is usable, for example, for making net packages for round balers.

BACKGROUND ART

Nets for round balers, i.e. nets produced starting from thermoplastic materials and usable in the agricultural sector are known in the state of the art. In fact, these nets for round balers are used for the containment of different types of fodder.

For example, such nets can be used for the containment of hay, straw or alfalfa, which suitably cut and dried are harvested by a machine, commonly known as a round baler, in cylindrical shaped structures known as a round bales. After the fodder has been harvested, a number of nets for round balers are applied to each round bale so that the fodder can be transported correctly.

It is also known that such nets for round balers are transported from the manufacturer to the distributors and/or resellers in the form of packages. Each package comprises a netting roll for round balers having a cylindrical shape. This netting roll is defined by the net for round balers wrapped around a cylindrical support.

Finally, it is known that the cylindrical shape of the roll does not help manual handling of the package. It is in fact difficult to have a good grip on the roll, thus making it risky to handle the roll itself.

Different solutions and methods are therefore known for applying, for example, handles to facilitate the transport of these rolls.

For example, a method is known that involves applying two polypropylene handles to a netting roll for round balers. In particular, according to this method of the prior art, the handles are held in position by ultrasonic welding and high-strength hot glue.

Problems of the Background Art

However, the package obtained with the method of the prior art is unsuitable for being handled and lifted by means of certified mechanical means such as, for example, hoists.

In other words, by lifting the handles of the package of the prior art by a mechanical means, the handles can break.

Consequently, the package of the prior art cannot be handled automatically but can only be handled manually.

SUMMARY OF THE INVENTION

In this context, the technical task underlying the present invention is to provide a method of applying a handle to a netting roll for round balers that overcomes the problems of the prior art.

In particular, it is an object of the present invention to propose a method of applying a handle to a netting roll for round balers that allows to obtain a net package for round balers that can be handled by, for example, a hoist.

The specified technical task and the specified purposes are substantially achieved by a method of applying a handle to a netting roll for round balers comprising the technical characteristics set forth in one or more of the joined claims.

Advantages of the Invention

The application method described allows to obtain a package for the transport of nets for round balers with handles certified for lifting by mechanical means.

The application method described also makes it possible to apply a handle corresponding to a certified lifting sling in polyester, or in other suitable material, to a netting roll for round balers.

In addition, the application method described allows to automate the process of applying a handle to a netting roll for round balers, allowing to obtain greater repeatability and greater precision of application.

BRIEF DESCRIPTION OF THE DRAWINGS

Further features and advantages of the present invention will become clearer from the indicative, and therefore non-limiting, description of a preferred, but not exclusive, embodiment of a method of applying a handle to a netting roll for round balers illustrated with reference to the accompanying figures in which.

DETAILED DESCRIPTION

Figure 1:
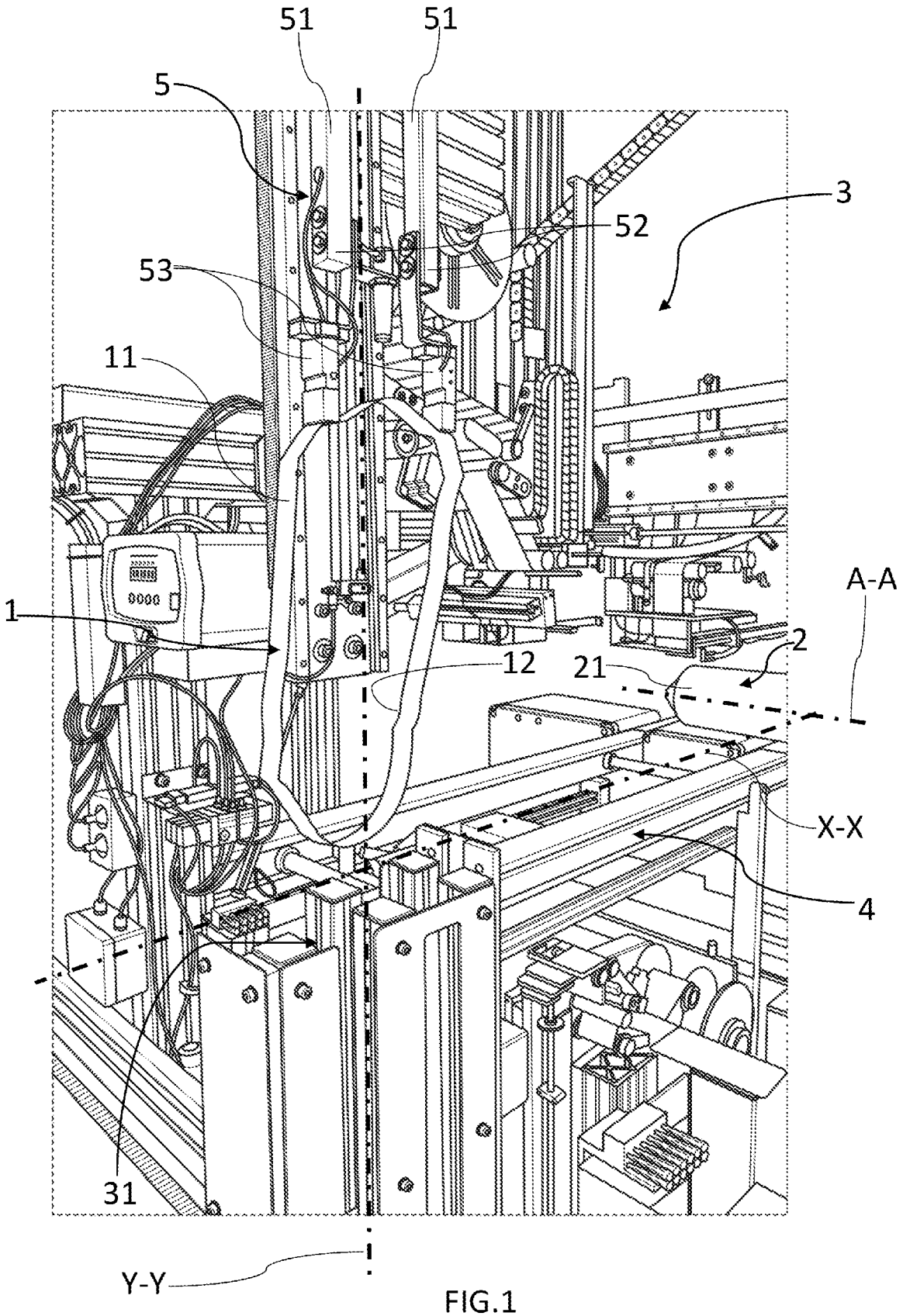
FIG. 1 is a perspective view of a first detail of an application equipment during a step of the application method object of the present invention.
Figure 2:
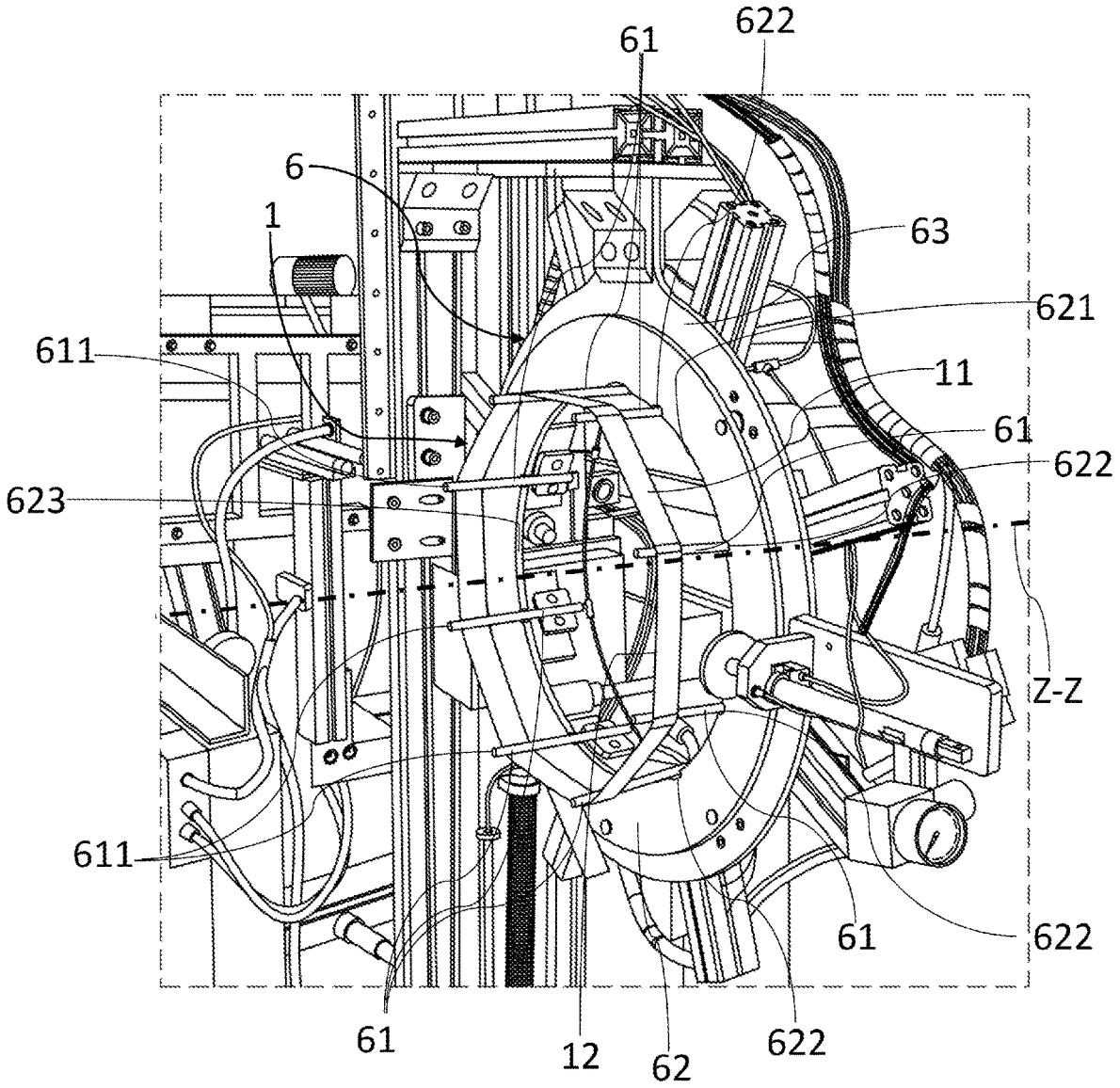
FIG. 2 is a perspective view of a second detail of the application equipment of FIG. 1 during a further step of the application method object of the present invention.
Figure 3:
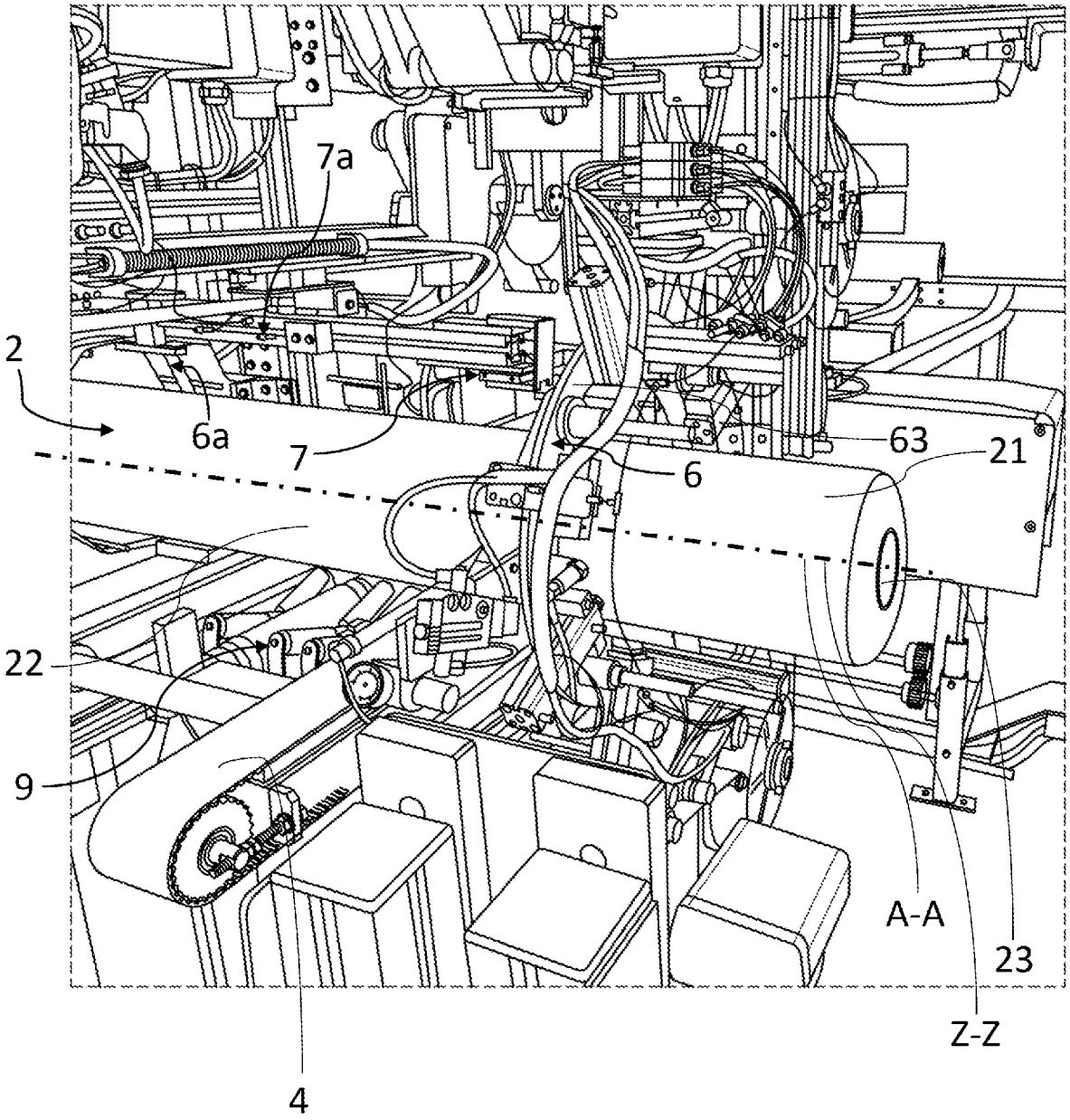
FIG. 3 is a perspective view of a third detail of the application equipment of FIG. 1 during a further step of the application method object of the present invention.
Figure 4:
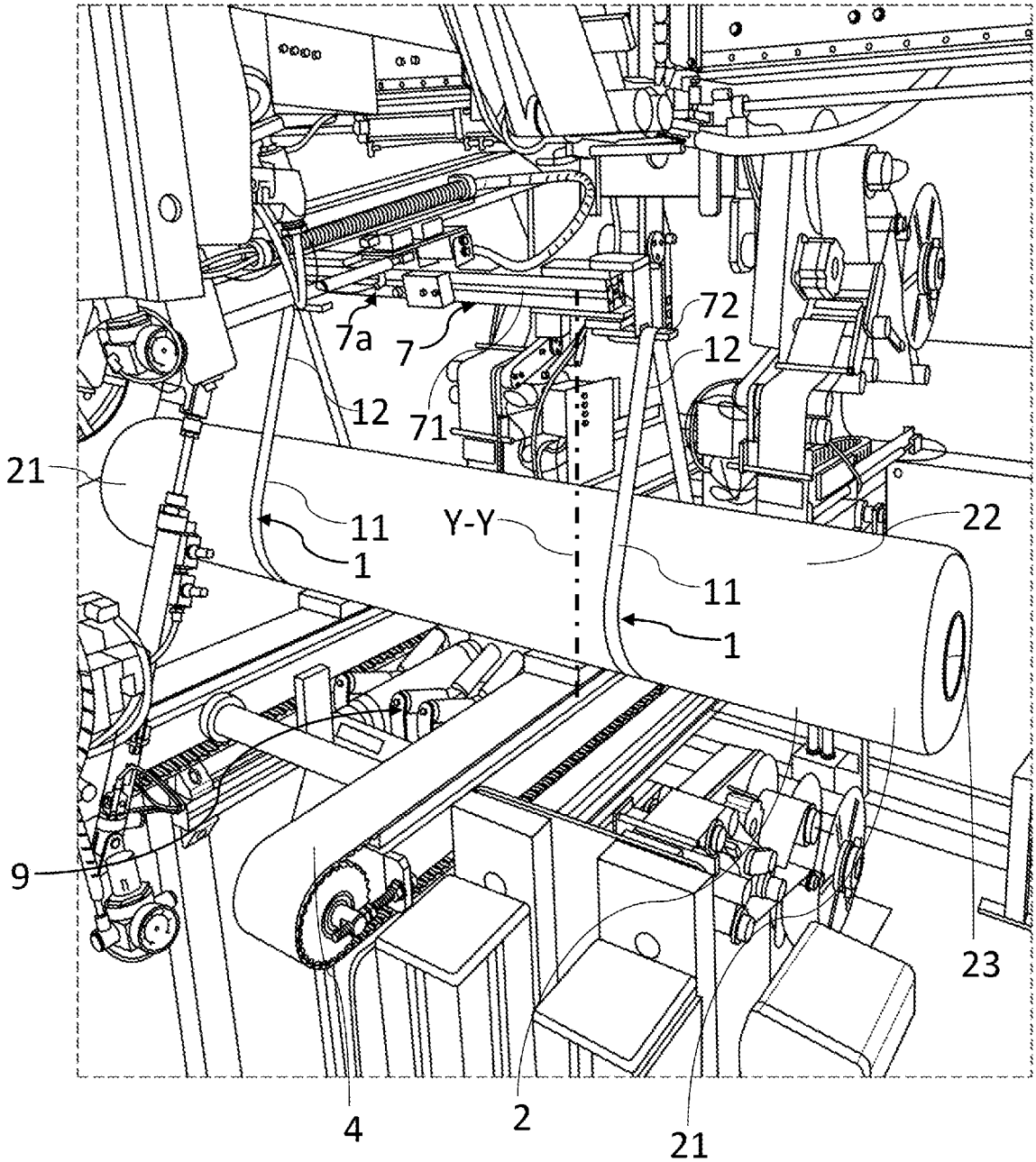
FIG. 4 is a perspective view of a fourth detail of the application equipment of FIG. 1 during a further step of the application method object of the present invention.
Figure 5:
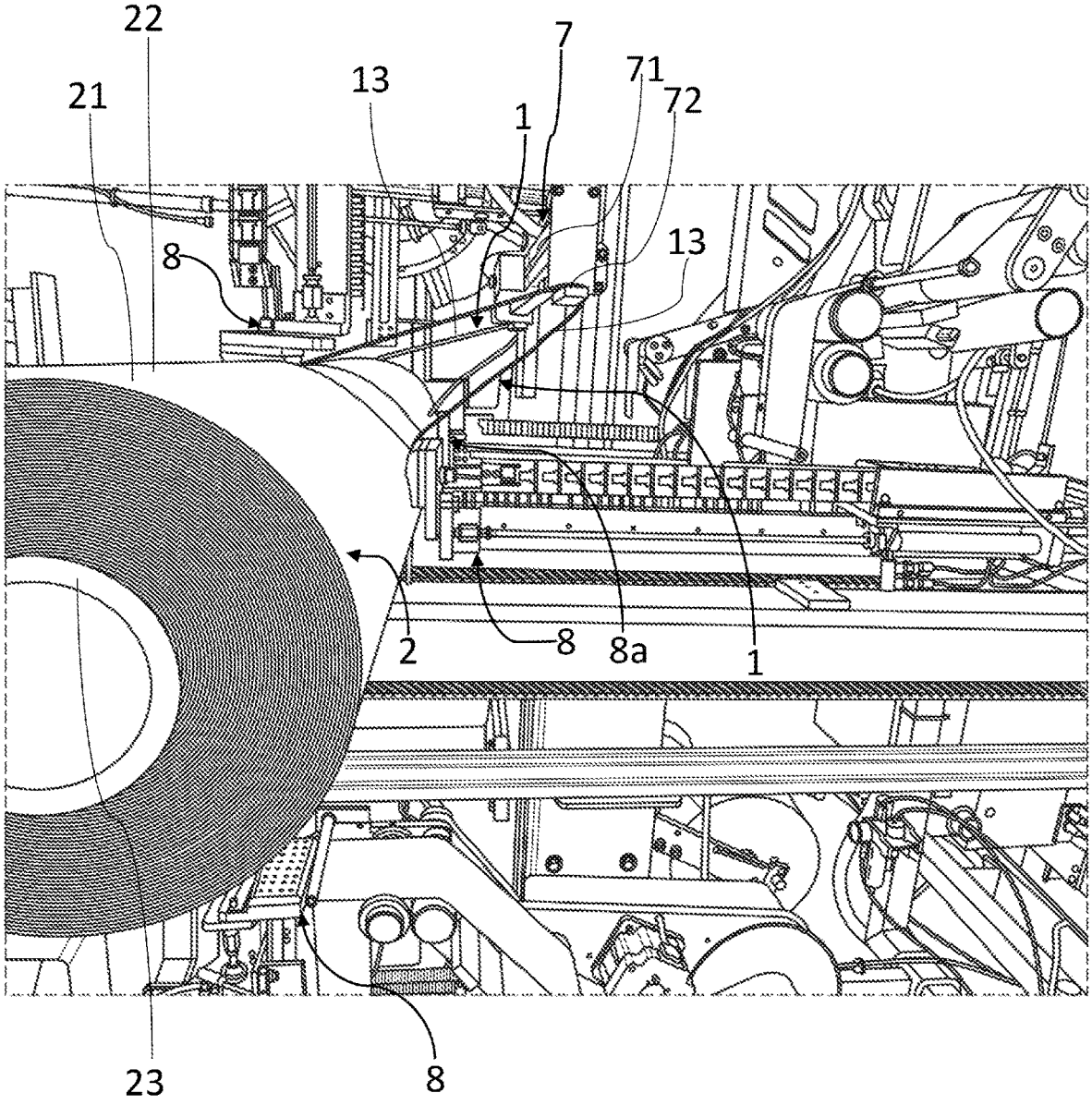
FIG. 5 is a perspective view of a fifth detail of the application equipment of FIG. 1 during a further step of the application method object of the present invention.

Below a package for the transport of nets for round balers is described.

The package comprises a netting roll 2 for round balers. This roll 2 comprises a cylindrical support 23 and a round baler net wrapped around the cylindrical support 23.

Preferably, the roll 2 comprises an outer casing 22, consisting of a film of plastic material, wrapped on the outer net layer to keep said net wrapped around the cylindrical support 23 and/or to protect the roll 2.

Still preferably, the roll 2 extends between a pair of mutually opposite end portions 21 along a prevailing development direction A-A of the roll 2.

The package further comprises at least one handle 1 comprising a flexible ring body 11 having a through opening 12. Preferably, the ring body 11 of the handle 1 is made in one piece. More preferably, the handle 1 corresponds to a certified lifting sling made of polyester or other suitable material.

The handle 1 is fitted onto the roll 2 thereby defining an area of overlap between the ring body 11 and the roll 2 and a grip area 13 of the ring body 11. The roll 2 is inserted into the through opening 12 of the ring body 11 of the handle 1.

Furthermore, the package comprises at least one fixing element applied to the ring body 11 of the handle 1 at the area of overlap by permanently fixing the handle 1 to the roll 2. Preferably, the fixing element corresponds to an adhesive label.

It should be noted that the grip area 13 of the ring body 11 of the handle 1 can be lifted manually or by certified mechanical means, thus allowing the transport of the roll 2.

According to a first preferred embodiment of the package, said package comprises a pair of handles 1. It should be noted that each handle 1 has a respective ring body 11 having a respective through opening 12.

Again, according to this first preferred embodiment of the package, each handle 1 is fitted onto the roll 2 at a respective end portion 21 of the roll 2, so that this roll 2 is inserted into the through openings 12 of the handles 1.

Still according to this first preferred embodiment of the package, each handle 1 is constrained to the roll 2 by means of a respective fixing element. For example, each handle 1 is constrained to the roll 2 by means of a respective adhesive label.

The object of the present invention is a method of applying the handle 1 to the netting roll 2 for round balers using an application equipment 3. In other words, through the application method it is possible to obtain the package described.

The application equipment 3 comprises a belt conveyor 4 defining a running plane extending in a running direction X-X. This belt conveyor 4 is configured to cause the roll 2 to run on the running plane along the running direction X-X.

Preferably, the belt conveyor 4 is configured to cause the roll 2 to run on the running plane maintaining the prevailing development axis A-A of the roll 2 transverse, in particular perpendicular, to the running direction X-X. More preferably, the belt conveyor 4 is configured to cause the roll 2 to run along the running plane avoiding the rotation of the roll 2 about the respective prevailing development axis A-A. In other words, the belt conveyor 4 is configured to rigidly translate the roll 2 along the running plane.

In addition, the application equipment 3 comprises a first operating element 5 configured to pick up the ring body 11 of the handle 1.

Said first operating element 5 is movable in the running direction X-X and in a first direction Y-Y transverse to the running direction X-X to carry the ring body 11. Preferably, the first direction Y-Y is perpendicular to the running direction X-X.

Preferably, the first operating element 5 is configured to assume an initial position, wherein said first operating element 5 is placed above the belt conveyor 4 and is configured to return to said initial position after carrying the ring body 11 of the handle 1.

Again preferably, the first operating element 5 is placed laterally to the belt conveyor 4.

The application equipment 3 further comprises a second operating element 6 movable in a second direction Z-Z, transverse to the first direction Y-Y and to the running direction X-X, to pick up the ring body 11 from the first operating element 5 and to fit the ring body 11 onto the roll 2 so that the roll 2 is introduced into the through opening 12 of the ring body 11. Preferably, the second direction Z-Z is perpendicular to both the first direction Y-Y and the running direction X-X.

Again preferably, when the roll 2 is arranged on the belt conveyor 4, the prevailing development axis A-A coincides with the second direction Z-Z.

Still preferably, the second operating element 6 is placed above the belt conveyor 4. Again preferably, the second operating element 6 is placed laterally to the belt conveyor 4.

In addition, the application equipment 3 comprises at least one applicator configured to apply at least one fixing element to the ring body 11 and the roll 2 to stably fix the ring body 11 to the roll 2 and thus defines a grip portion 13 of the handle 1.

The application equipment 3 further comprises a third operating element 7 configured to apply a pulling force to the ring body 11 during the application of the fixing element to the ring body 11 and the roll 2. Preferably, also said third operating element 7 is placed above the belt conveyor 4.

The application method comprises the step of picking up, by means of the first operating element 5, the ring body 11 of the handle 1.

In addition, the application method comprises the step of placing the roll 2 on the running plane of the belt conveyor 4. Preferably, the roll 2 is arranged on the belt conveyor 4 in such a way that the prevailing development axis A-A of the roll 2 coincides with the second direction Z-Z.

After placing the roll 2 on the belt conveyor 4, the application method comprises the step of causing, by means of the belt conveyor 4, the roll 2 to run in the running direction X-X up to the second operating element 6. In other words, the roll 2 is aligned with the second operating element 6. Preferably, the roll 2 is carried up to a position where the second operating element 6 faces an end portion 21 of the roll 2.

After picking up the ring body 11 of the handle 1, the application method comprises the step of conveying through the first operating element 5, the ring body 11 of the handle 1 to position the ring body 11 at the second operating element 6. As will be clearer below, the first operating element 5 is moved in the running direction X-X and in the first direction Y-Y to position the ring body 11 of the handle 1 at the second operating element 6. In other words, through the first operating element 5 the ring body 11 of the handle 1 is aligned with the second operating element 6.

The application method therefore comprises the step of picking up, by means of the second operating element 6, the ring body 11 from the first operating element 5. After the ring body 11 has been picked up by the first operating element 5, said first operating element 5 is preferably configured to automatically return to the initial position.

Subsequently, the application method comprises the step of fitting, by means of the second operating element 6, the ring body 11 onto the roll 2. Preferably, the ring body 11 of the handle 1 is fitted on the roll 2 at an end portion 21 of the roll 2.

After the ring body 11 has been fitted onto the roll 2, said second operating element 6 is moved away from the roll 2.

In addition, the application method comprises the step of exerting, by means of the third operating element 7, a pulling force on the ring body 11.

The application method therefore comprises the step of applying, by means of the applicator, at least one fixing element to the ring body 11 of the handle 1 and the roll 2 to fix the ring body 11 to the roll 2 and thus defining a grip portion 13 of the handle 1. It should be noted that the fixing element is applied during the application of the pulling force by the third operating element 7.

After application of the fixing element, the method comprises the step of releasing, by means of the third operating element 7, the pulling force applied to the ring body 11.

Finally, the application method comprises the step of removing the roll 2 from the belt conveyor 4 by moving it in the second direction Z-Z through rollers 9 of the application equipment 3 and appropriate belts (not shown in the accompanying figures) external to the application equipment 3. These rollers 9 are arranged on the same level as the belt conveyor 4 and during the sliding of the roll 2 on the belt conveyor 4 the roll 2 remains arranged above these rollers 9.

According to a preferred aspect, the first operating element 5 comprises a pair of lifting arms 51. Each lifting arm 51 extends in the first direction Y-Y and has a respective terminal end 52.

Preferably, each lifting arm 51 is movable in the running direction X-X and in the first direction Y-Y.

According to a further preferred aspect, the first operating element 5 comprises a pair of grippers 53. Each gripper 53 is connected to a respective lifting arm 51 at the respective terminal end thereof 52.

In accordance with the preferred embodiment of the invention, the step of picking up, by means of the first operating element 5, the ring body 11 of the handle 1 comprises gripping, by means of the grippers 53, the ring body 11.

Again, in accordance with the preferred embodiment of the invention, the step of carrying, by means of the first operating element 5, the ring body 11 of the handle 1 comprises moving the lifting arms 51 in the first direction Y-Y to align the ring body 11 of the handle 1 with the second operating element 6. In other words, by moving the ring body 11 of the handle 1 in the first direction Y-Y, said ring body 11 is placed at the same height as the second operating element 6.

Preferably, after aligning the ring body 11 to the second operating element 6, the step of carrying, by means of the first operating element 5, the ring body 11 of the handle 1, comprises moving the lifting arms 51 in the running direction X-X until the ring body 11 of the handle 1 is placed at the second operating element 6.

In other words, the lifting arms 51 are moved to place the ring body 11 of the handle 1 in a position in which the second operating element 6 can pick up said ring body 11 of the handle 1.

According to a preferred aspect, the application equipment 3 comprises a container 31 at the belt conveyor 4. This container 31 is configured to contain the handle 1. Preferably, said container 31 is configured to contain the handle 1 so as to allow it to be picked up by means of the operating element 5.

In accordance with the preferred embodiment of the invention, before the step of picking up, by means of the first operating element 5, the ring body 11 of the handle 1, the application method comprises the step of moving the lifting arms 51 in the running direction X-X to align the grippers 53 to the container 31 and moving the lifting arms 51 in the first direction Y-Y toward the container 31 to place the grippers 53 proximate to the ring body 11 of the handle 1. Preferably, the grippers 53 are inserted inside the container 31 to grip the ring body 11 of the handle 1.

Again in accordance with the preferred embodiment of the invention, after the step of picking up, by means of the first operating element 5, the ring body 11 of the handle 1 and before the step of carrying, by means of the first operating element 5, the ring body 11 of the handle 1, the method comprises the step of moving the lifting arms 51 in the first direction Y-Y away from the container 31 to pull the handle 1 out of the container 31. During the step of pulling the handle 1 out of the container 31, i.e. during the lifting of the handle 1 by means of the grippers 53, the ring body 11 of the handle 1 progressively and automatically extends in the first direction Y-Y.

According to a preferred aspect of the invention, the second operating element 6 comprises a plurality of gripping arms 61. For example, the second operating element 6 comprises eight gripping arms 61.

Each gripping arm 61 extends in the second direction Z-Z and is movable in said second direction Z-Z. Preferably, each gripping arm 61 is movable in the second direction Z-Z by pneumatic means or by mechanical/electromechanical means.

Still preferably, the second operating element 6 comprises a ring support 63. The gripping arms 61 are connected to such a ring support 63. Again preferably, the gripping arms 61 are equally spaced from each other along a circumferential direction defined by the ring support 63.

In accordance with the preferred embodiment of the invention, the step of picking up, by means of the second operating element 6, the ring body 11 from the first operating element 5 comprises moving the gripping arms 61 in the second direction Z-Z toward the ring body 11 to insert such gripping arms 61 into the through opening 12 of the ring body 11 and releasing the ring body 11 from the first operating element 5.

Still preferably, the second operating element 6 comprises detection sensors configured to detect the presence of the ring body 11 of the handle 1. In other words, such detection sensors 6 are configured to verify that the ring body 11 of the handle 1 has been correctly picked up from the gripping arms 61.

Still in accordance with the preferred embodiment of the invention, after the step of picking up, by means of the second operating element 6, the ring body 11 from the first operating element 5 and before the step of fitting, by means of the second operating element 6, the ring body 11 onto the roll 2, the method comprises the step of adapting, by means of the gripping arms 61 of the second operating element 6, the dimensions of the through opening 12 of the ring body 11 to the dimensions of the roll 2. In other words, the gripping arms 61 are configured to tension the ring body 11 of the handle 1. For example, the gripping arms 61 are moved away from each other to increase the dimension of the through opening 12 of the ring body 11.

According to a further preferred aspect, the second operating element 6 comprises a release ring 62 movable in the second direction Z-Z. Preferably, also the release ring 62 is connected to the ring support 63. Again preferably, the gripping arms 61 are arranged inside a respective through opening 621 of the release ring 62.

Still preferably, the release ring 62 comprises a plurality of niches 622 arranged at an edge 623 of the release ring 62 delimiting the through opening 621. Each gripping arm 61 is inserted within a respective niche 622 and is configured to slide within the respective niche 622 in the second direction Z-Z.

In accordance with the preferred embodiment of the invention, the step of fitting, by means of the second operating element 6, the ring body 11 onto the roll 2 comprises moving the gripping arms 61 in the second direction Z-Z toward the roll 2 to place the ring body 11 around the roll 2. In other words, the movement of the gripping arms 61 in the second direction Z-Z allows the roll 2 to be inserted into the through opening 12 of the ring body 11. For example, an end portion 21 of the roll 2 is inserted into the through opening 12 of the ring body 11. It should be noted that, during the movement of the gripping arms 61 to fit the ring body 11 onto the roll 2, these gripping arms 61 slide around the roll 2.

After moving the gripping arms 61 in the second direction Z-Z toward the roll 2, the step of fitting, by means of the second operating element 6, the ring body 11 onto the roll 2 comprises moving the release ring 62 in the second direction Z-Z toward the roll 2 to remove the ring body 11 from the gripping arms 61 by sliding the ring body 11 along the gripping arms 61. The movement of the release ring 62 in the second direction Z-Z toward the roll 2 then pushes the ring body 11 up to past a respective terminal catching end 611 of each gripping arm 61.

It should be noted that, during the sliding of the release ring 62 to remove the ring body 11 from the gripping arms 61, the roll 2 remains inserted in the through opening 621 of said release ring 62.

After removing the ring body 11 from the gripping arms 61, the step of fitting, by means of the second operating element 6, the ring body 11 onto the roll 2 comprises moving the gripping arms 61 and the release ring 62 in the second direction Z-Z away from the roll 2.

According to a preferred aspect, the third operating element 7 comprises a tensioning arm 71 having a catching end 72. Preferably, the tensioning arm 71 is arranged in the second direction Z-Z. Still preferably, the tensioning arm 71 is movable in the first direction Y-Y. For example, the tensioning arm 71 is operable by a pneumatic piston.

Again preferably, the catching end 72 of the tensioning arm 71 is movable in the second direction Z-Z.

In accordance with the preferred embodiment of the invention, the step of exerting, by means of the third operating element 7, a pulling force on the ring body 11 comprises inserting the catching end 72 into the through opening 12 of the ring body 11. Preferably, when the release ring 62 pushes the ring body 11 to remove it from the gripping arms 61, the catching end 72 is placed so as to receive the ring body 11. In other words, preferably, through the release ring 62 the ring body 11 passes from the gripping arms 61 to the catching end 72 of the tensioning arm 71 being simultaneously fitted onto the roll 2.

After the catching end 72 has received the ring body 11, the step of exerting, by means of the third operating element 7, a pulling force on the ring body 11 comprises moving the tensioning arm 71 in the first direction Y-Y away from the roll 2 to apply a pulling force on the ring body 11.

Still in accordance with the preferred embodiment of the invention, the step of releasing, by means of the third operating element 7, the pulling force applied to the ring body 11 comprises moving the catching end 72 of the tensioning arm 71 in the second direction Z-Z away from the ring body 11 to remove the catching end 72 from the through opening 12 of the ring body 11.

According to a further preferred aspect, the applicator comprises at least one labeller 8. As will be clearer below, the labeller 8 is configured to apply an adhesive label to bind the ring body 11 of the handle 1 to the roll 2.

Preferably, the applicator comprises three labellers 8. For example, the applicator comprises a first labeller 8 positioned below the belt conveyor 4 and a second and a third labeller 8 positioned above said belt conveyor 4.

In accordance with the preferred embodiment of the invention, the step of applying, by means of the applicator, at least one fixing element on the ring body 11 of the handle 1 and the roll 2 to fix the ring body 11 to the roll 2 comprises applying, by means of the at least one labeller 8, at least one fixing element corresponding to an adhesive label in an area of overlap of the ring body 11 to the roll 2 to fix the ring body 11 to the roll 2 thereby defining a gripping portion 13 of the ring body 11 of the handle 1.

In the embodiment in which the applicator comprises the first, second and third labeller 8, said first, second and third labeller 8 are configured to apply a respective adhesive label, respectively, in a first, second and third area of overlap between the ring body 11 and the roll 2.

Preferably, the first area of overlap is facing the running plane of the belt conveyor 4. Again preferably, the second area of overlap is facing away from the running plane of the belt conveyor 4. Still preferably, the third area of overlap is placed in contact with the belt conveyor 4 and is arranged transversely to said belt conveyor 4. In accordance with a first preferred embodiment of the application equipment 3, said application equipment 3 comprises a further first operating element (not illustrated in the accompanying figures), a further second operating element **6*a*, a further third operating element 7*a* and a further applicator 8*a* corresponding, respectively, to the first operating element 5, the second operating element 6, the third operating element 7** and the applicator.

It should be noted that by means of the first preferred embodiment of the application equipment 3 it is possible to simultaneously apply a pair of handles 1 to the roll 2, while simultaneously performing the application method described for each handle 1 of the pair of handles 1. In other words, one handle 1 of the pair of handles 1 is applied to the roll 2 using the first operating element 5, the second operating element 6, the third operating element 7 and the applicator, while the other handle 1 of the pair of handles 1 is applied to the roll 2 using the further first operating element, the further second operating element **6*a*, the further third operating element 7*a* and the further applicator 8*a***.

The invention claimed is:

1. A method of applying a handle to a netting roll for round balers using an application equipment, said handle comprising a flexible ring body having a through opening, said application equipment comprising:

a belt conveyor defining a running plane extending in a running direction, said belt conveyor being configured to cause said roll to run on the running plane along the running direction;

a first operating element configured to pick up the ring body of the handle and being movable in the running direction and in a first direction transverse to the running direction to carry said ring body;

a second operating element which is able to move in a second direction, transverse to the first direction and to the running direction, to pick up the ring body from the first operating element and to fit said ring body onto the roll so that that the roll may be introduced into the through opening of said ring body;

at least one applicator configured to apply at least one fixing element to the ring body and the roll to stably fix said ring body to the roll and thus define a grip portion of the handle;

a third operating element configured to apply a pulling force to the ring body during application of the fixing element to the ring body and the roll;

wherein said method of applying comprises the steps of:

picking up, by means of the first operating element, the ring body of the handle;

placing the roll on the running plane of the belt conveyor and causing said roll to run, by means of the belt conveyor, in the running direction up to the second operating element;

conveying, by means of the first operating element, the ring body of the handle to position said ring body at the second operating element;

picking up, by means of the second operating element, the ring body from the first operating element;

fitting, by means of the second operating element, said ring body onto the roll exerting, by means of the third operating element, said pulling force on said ring body;

applying, by means of the applicator, the at least one fixing element to the ring body of the handle and the roll to fix said ring body to the roll and thus define said grip portion of the handle;

releasing, by means of the third operating element, the pulling force applied to the ring body.

2. The method as claimed in claim 1, wherein:

the first operating element comprises:

a pair of lifting arms, each lifting arm extending in the first direction and having a respective end; each lifting arm being movable in the running direction and in the first direction;

a pair of grippers, each gripper being connected to a respective lifting arm at its respective end;

the step of picking up, by means of the first operating element, the ring body of the handle comprises gripping, by means of the grippers, said ring body;

the step of carrying, by means of the first operating element, the ring body of the handle comprises:

moving the lifting arms in the first direction to align the ring body of the handle with the second operating element;

moving the lifting arms in the running direction until the ring body of the handle is placed at the second operating element.

3. The method as claimed in claim 2, wherein:

said application equipment comprises a container at the belt conveyor, said container being configured to contain the handle;

before the step of picking up, by means of the first operating element, the ring body of the handle, the method comprises the step of moving the lifting arms in the running direction to align the grippers with the container and moving the lifting arms in the first direction toward the container to place the grippers proximate to the ring body of the handle;

after the step of picking up, by means of the first operating element, the ring body of the handle and before the step of carrying, by means of the first operating element, the ring body of the handle, the method comprises the step of moving the lifting arms in the first direction away from the container to pull the handle out of the container.

4. The method as claimed in claim 1, wherein:

the second operating element comprises a plurality of gripping arms, each gripping arm extending in the second direction and being movable in said second direction;

the step of picking up, by means of the second operating element, the ring body from the first operating element comprises moving the gripping arms in the second direction toward the ring body to insert said gripping arms into the through opening of the ring body and release the ring body from the first operating element.

5. The method as claimed in claim 4, wherein:

after the step of picking up, by means of the second operating element, the ring body from the first operating element and before the step of fitting, by means of the second operating element, said ring body onto the roll, the method comprises the step of adapting, by means of the gripping arms of the second operating element, the dimensions of the through opening of the ring body to the dimensions of the roll.

6. The method as claimed in claim 4, wherein:

the second operating element comprises a release ring movable in the second direction;

the step of fitting, by means of the second operating element, said ring body onto the roll comprises:

moving the gripping arms in the second direction toward the roll to position the ring body around the roll;

moving the release ring in the second direction toward the roll to remove the ring body from the gripping arms by sliding said ring body along the gripping arms;

moving the gripping arms and the release ring in the second direction away from the roll.

7. The method as claimed in claim 1, wherein:

the third operating element comprises a tensioning arm having a catching end, said tensioning arm being movable in the first direction;

the step of exerting, by means of the third operating element, said pulling force on said ring body comprises:

inserting the catching end into the through opening of the ring body;

moving the tensioning arm in the first direction away from the roll to apply said pulling force to said ring body.

8. The method as claimed in claim 7, wherein:

the catching end of the tensioning arm is movable in the second direction;

the step of releasing, by means of the third operating element, the pulling force applied to the ring body, comprises moving the catching end of the tensioning arm in the second direction away from the ring body to pull said catching end off the through opening of the ring body.

9. The method as claimed in claim 1, wherein:

the applicator comprises at least one labeller;

the step of applying, by means of the applicator, at least one fixing element to the ring body of the handle and to the roll to fix said ring body to the roll comprises applying, by means of the at least one labeller, at least one fixing element consisting of an adhesive label in an area of overlap of the ring body and the roll to fix said ring body to the roll thereby defining said grip portion of the ring body of the handle.

* * * * *